United States Patent [19]

Celaries

[11] Patent Number: 4,706,341

[45] Date of Patent: Nov. 17, 1987

[54] WRITING INSTRUMENT CAP AND CLIP THEREFOR

[75] Inventor: Jean E. Celaries, Faverges, France

[73] Assignee: S. T. Dupont, Paris, France

[21] Appl. No.: 418,882

[22] Filed: Sep. 16, 1982

Related U.S. Application Data

[63] Continuation of Ser. No. 241,312, Mar. 6, 1981, abandoned.

[30] Foreign Application Priority Data

Mar. 12, 1980 [FR] France ..... 80 05525

[51] Int. Cl.[4] ..... B43K 9/00; B43K 25/00

[52] U.S. Cl. ..... 24/11 R; 24/11 F; 401/243

[58] Field of Search ..... 24/11 R, 11 S, 11 C, 24/11 F, 11 M, 11 P; 401/243, 244, 245, 246, 247

[56] References Cited

U.S. PATENT DOCUMENTS

| | | | |
|---|---|---|---|
| 1,111,469 | 9/1914 | Kraker | 24/11 F |
| 1,326,206 | 12/1919 | Luck | 24/11 P |
| 1,490,231 | 4/1924 | Poole | 24/11 M |
| 1,720,471 | 7/1929 | Fritsch | 24/11 S |
| 1,776,384 | 9/1930 | Garabedian . | |
| 1,838,747 | 12/1931 | Deli . | |
| 1,922,831 | 8/1933 | Vivian | 401/246 X |
| 2,048,127 | 7/1936 | Larsen | 24/11 |
| 2,146,609 | 2/1939 | Welsh | 24/11 |
| 2,418,218 | 4/1947 | Bauer et al. | 24/11 |
| 2,460,728 | 2/1949 | Aversa | 24/11 |
| 2,512,031 | 6/1950 | Marcoux | 24/11 |
| 2,533,082 | 12/1950 | Baker et al. | 401/247 |
| 2,939,426 | 6/1960 | Rodenhauser et al. | 401/247 |
| 3,323,494 | 6/1967 | Mutschuler | 120/42.01 |

FOREIGN PATENT DOCUMENTS

| | | |
|---|---|---|
| 1060752 | 6/1954 | France . |
| 334570 | 9/1930 | United Kingdom . |
| 420164 | 11/1934 | United Kingdom . |

*Primary Examiner*—Steven A. Bratlie

*Attorney, Agent, or Firm*—Raymond J. De Vellis

[57] ABSTRACT

The invention relates to a writing instrument cap and clip therefor. The cap has secured thereto an immovable end piece made rotationally integral with the cap by the heel portion of the clip being sunk into a notch in the cap.

9 Claims, 5 Drawing Figures

WRITING INSTRUMENT CAP AND CLIP THEREFOR

This application is a continuation of application Ser. No. 241,312, filed Mar. 6, 1981, now abandoned.

BACKGROUND OF THE INVENTION

1. Field of the Invention

The present invention relates to writing instruments, such as fountain pens and mechanical pencils, having a cap provided with a clip, and relates in particular to means for securing together the end piece of the cap and the clip.

2. Description of the Prior Art

In most writing instruments having a cap, the end piece of the latter comprises an additional or separate piece generally screwed to the body of the cap. Such an arrangement enables manufacture of the cap to be simplified by making it possible, for example, to use shaped tubes. Because of improved accessibility, this arrangement also improves maintenance of any mechanism internal to the cap.

However, it has been found that, after a certain length of time in service, cap end pieces mounted in this way tend to unscrew or otherwise become loose. This drawback is all the more serious in that most of the time such an end piece also holds the clip of the writing instrument in place.

To prevent the end piece from becoming accidentally unscrewed, it has been proposed that a washer of the spring lock washer type be wedged between the cap and the end piece. However, since this method of immobilization is unattractive in appearance, it is suitable for use only in inexpensive writing instruments.

SUMMARY OF THE INVENTION

Accordingly it is an object of the present invention to overcome the drawbacks cited above by providing means for attaching the cap end piece of a writing instrument in a way that does not call for any additional mounting device on the outside.

With the above object in view a feature of the present invention is the provision of a writing instrument of the type having a cap and a clip, the cap being provided with a removable end piece whose translational immobilization with respect to the cap is dependent upon rotational immobilization, characterized by said end piece and said cap being rotationally integrated by means of the heel portion of said clip.

Thus in writing instruments according to the invention the rotational connection between the end piece of the cap is provided by the heel of the clip. This rotational connection insures complete integration of the end piece and the cap, since, in writing instruments according to the invention, translational immobilization of the end piece is dependent upon its rotational immobilization. In other words, in order to immobilize the end piece with respect to trnslation, it is necessary and sufficient to immobilize it with respect to rotation. This is the case, for example, when the end piece is screwed to the cap or when it is disposed thereon by means of a bayonet system.

BRIEF DESCRIPTION OF THE DRAWING

Several embodiments of the invention are described hereinbelow with reference to the accompanying drawing, in which.

DESCRIPTION OF THE PREFERRED EMBODIMENT

Figure 1:
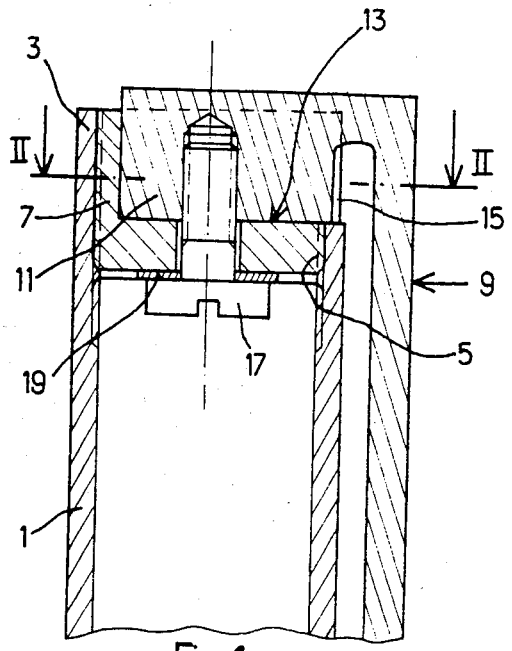
FIG. 1 is a partial section through a writing instrument according to the invention.
Figure 3:
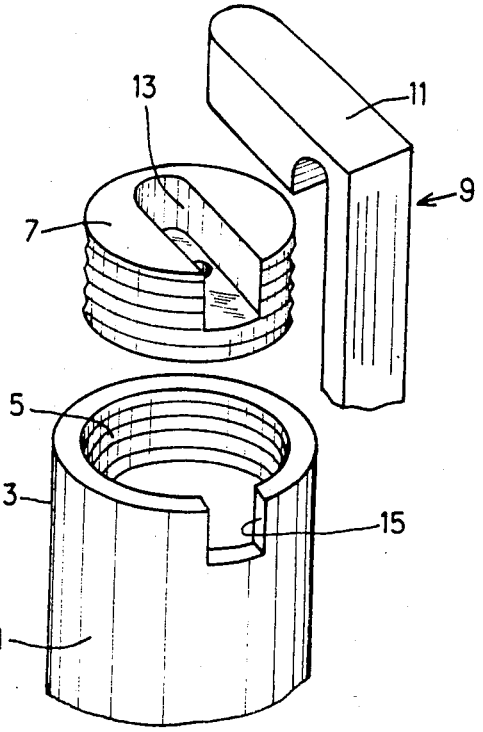
FIG. 3 is an exploded perspective view of the cap, the end piece, and the clip.
Figure 2:
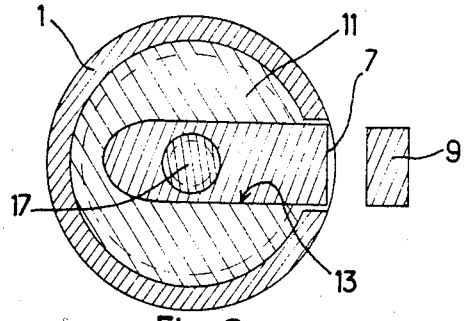
FIG. 2 is a radial section along line II—II of FIG. 1.

In FIGS. 1 to 3 the cap is composed of a tubular body provided at one of its ends 3 with an internal thread 5. An end piece 7 comprising a threaded plug is screwed into thread 5. A clip 9 includes a heel portion 11, which fits both into a groove 13 in the upper part of end piece 7 and into a notch 15 in the upper edge of cap 1. Heel 11 is connected to end piece 7 by a screw 17 with interposition of a split lock washer 19.

Under these conditions, end piece 7 being screwed to body 1, its translational immobilization is dependent upon its rotational immobilization. In fact end piece 7 will be immobilized translationally only when it becomes impossible to screw it or unscrew it, i.e. when it has been immobilized rotationally. Rotational immobilization is provided by the heel of the clip, since the latter is at the same time connected to end piece 7 and anchored into notch 15 of cap 1.

Figure 4:
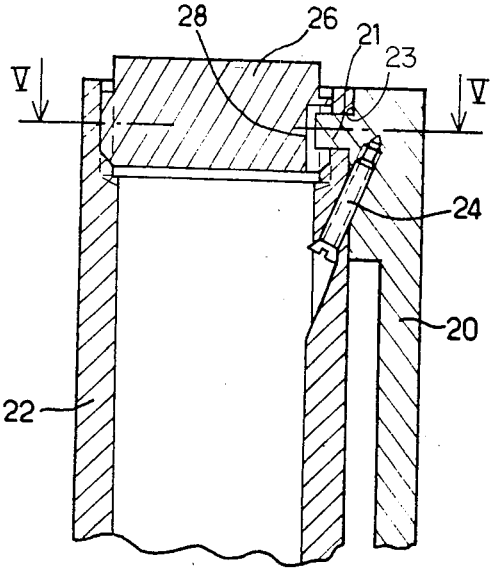
FIG. 4 is a cross section of a further embodiment of the invention.
Figure 5:
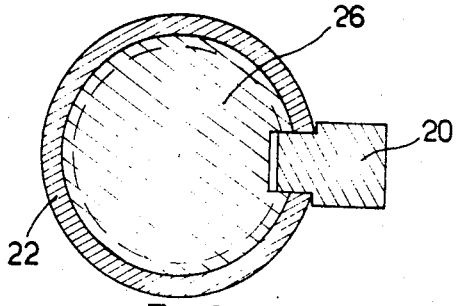
FIG. 5 is a cross section along line V—V of FIG. 4.

It is quite apparent that without departing from the spirit of the invention, certain structural details or their arrangement could be modified to obtain the same result. Thus, as shown in FIGS. 4 and 5, clip 20 and cap 22 could be integrated by means of a screw 24, and the rotational link between the clip and end piece 26 is provided by fitting heel 21 of clip 20 through slot 23 in the cap wall into lateral recess 28 in the end piece.

The end piece could also be connected to the cap by means other than screw threads whereby translational immobilization of the cap would be dependent upon its rotational immobilization. For example the end piece could also be attached to the cap by means of a bayonet system.

What is claimed is:

1. A cap for a writing instrument comprising:

a generally cylindrical tubular body having an internally threaded opening at a top end, and a slot in said top end;

a removable end piece screw threaded in said opening, said end piece including a cavity;

a removable clip releasably secured in said cavity and in said slot to said end piece, whereby rotation, and thereby translation, of said end piece with respect to said tubular body is substantially prevented; and screw means accessable from inside said tubular body for releasably securing said clip with respect to said end piece.

2. The cap as in claim 1 wherein said clip includes a heel portion, said heel portion being secured in said cavity of said end piece by said screw means from the inside of said top end of said tubular body.

3. The cap as in claim 2 wherein said slot in said top end is formed on the edge of said top end.

4. The cap as in claim 3 wherein said cavity is formed on an upper surface of said end piece.

5. The cap as in claim 4 wherein said cavity in said end piece and said slot in said top end are in alignment.

6. The cap as in claim 1 wherein said clip is secured to said top end of said tubular body by said screw means.

7. The cap as in claim 6 wherein said slot in said top end is below an edge of said top end.

8. The cap as in claim 7 wherein said cavity in said end piece is a lateral recess.

9. The cap as in claim 8 wherein said lateral recess in said end piece and said slot in said top end are in alignment.

* * * * *